US005277504A

United States Patent [19]

Takeda

[11] Patent Number: 5,277,504

[45] Date of Patent: Jan. 11, 1994

[54] PRINTING APPARATUS USING RIBBON CASSETTE

[75] Inventor: Susumu Takeda, Kasugai, Japan

[73] Assignee: Brother Kyogo Kabushiki Kaisha, Nagoya, Japan

[21] Appl. No.: 942,174

[22] Filed: Sep. 9, 1992

[30] Foreign Application Priority Data

Sep. 20, 1991 [JP] Japan ..... 3-270376

[51] Int. Cl.[5] ..... B41J 35/28

[52] U.S. Cl. ..... 400/208; 242/189; 242/190

[58] Field of Search ..... 400/208, 242, 249, 219.1, 400/223, 234, 703, 711, 712, 196.1; 242/186, 188, 189, 190

[56] References Cited

U.S. PATENT DOCUMENTS

| | | | |
|---|---|---|---|
| 2,365,254 | 12/1944 | Dolan | 400/249 |
| 4,091,913 | 5/1978 | Ku et al. | 400/196.1 |
| 4,146,338 | 3/1979 | Hedstrom | 400/249 |
| 4,213,575 | 7/1980 | Firth | 400/219.2 |
| 4,375,339 | 3/1983 | Dyer et al. | 400/249 |
| 4,406,554 | 9/1983 | Dreinhoff | 400/249 |
| 4,407,593 | 10/1983 | Haftmann | 400/208 |
| 4,428,695 | 1/1984 | Jamieson | 400/249 |
| 4,479,730 | 10/1984 | Yoshioka et al. | 400/208 |
| 4,491,430 | 1/1985 | Kuelzer | 400/249 |
| 4,780,011 | 10/1988 | Hasegawa et al. | 400/242 |
| 4,793,723 | 12/1988 | Furhata | 400/249 |
| 4,998,833 | 3/1991 | Chiman | 400/242 |

FOREIGN PATENT DOCUMENTS

| | | | |
|---|---|---|---|
| 2646603 | 4/1978 | Fed. Rep. of Germany | 400/249 |
| 57-199680 | 12/1982 | Japan . | |
| 61-95975 | 5/1986 | Japan . | |
| 61-195882 | 8/1986 | Japan . | |
| 2179917 | 3/1987 | United Kingdom | 400/249 |

OTHER PUBLICATIONS

"Ribbon Take-Up System Using a DC Motor and an Optical Encoder", IBM Tech. Disc. Bulletin, vol. 27, No. 10B, Mar. 1985, pp. 6156-6157.

"End of Ribbon Detector" IBM Technical Disclosure Bulletin, vol. 20, No. 6, Nov. 1977, pp. 2173-2174.

*Primary Examiner*—Eugene H. Eickholt

*Attorney, Agent, or Firm*—Oliff & Berridge

[57] ABSTRACT

A printing apparatus is capable of detecting the end of an ink ribbon and verifying normal mounting of a ribbon cassette. When a portion of ink ribbon sufficient for printing one character is transported, an actuator in the ribbon cassette is rotated by a predetermined amount. The rotating actuator turns on and off a switch. The number of times the switch status is changed is detected. Determining the switch ON-OFF count makes it possible to detect the ink ribbon end and to check for any abnormal winding operation of the ink ribbon. Thus a single switch arrangement permits detection of both the ink ribbon end and an abnormal ink ribbon winding operation that may occur.

18 Claims, 5 Drawing Sheets

PRINTING APPARATUS USING RIBBON CASSETTE

BACKGROUND OF THE INVENTION

1. Field of the Invention

The present invention relates to a printing apparatus implemented in the form of a printer, a typewriter, word processor or like equipment using an ink ribbon for printing purposes.

2. Description of Related Art

Printing apparatuses that use an ink ribbon cassette are well known. In the typical printing apparatus, the ink ribbon cassette is removably mounted on a carriage. When a user operates a print start button or like switch, not shown, the unused ink ribbon wound inside the ribbon cassette starts to be fed toward the printing area of the apparatus in synchronism with its continuous printing operation. In this type of machine, when the unused ink ribbon inside the ink ribbon cassette has reached its end, no more printing is available. There have been proposed printing apparatuses having mechanisms for detecting the end of the ink ribbon. When the detecting mechanism detects the ink ribbon end during operation, the printing apparatus stops further printing action and issues a message prompting the user to change the ink ribbon cassette. One such detecting mechanism is disclosed in Japanese Patent Laid-Open No. Sho 61-195882. This mechanism, using a reflection type photosensor and operating in a printing apparatus, works as follows. A silver-colored reflective tape is attached to the end of the ink ribbon. When the reflection type photosensor detects a difference between the reflection from the tape surface and the reflection from the reflective tape, the photosensor interprets the difference as an indication of the end of the ink ribbon. One disadvantage of this mechanism is its poor reliability. That is, the photosensor can malfunction if the ink ribbon is not the usual black ribbon but a color ribbon that reflects incident light better. Because some color ribbons reflect light better than the black ribbon, the reflected light from the tape can be erroneously interpreted by the photosensor as the end of the ribbon. This stops the printing operation even though a large usable portion of ink ribbon still remains inside the cartridge. Another disadvantage is that a reflective tape is attached to the end of every ink ribbon, to thus increase a cost of the ink ribbon.

Other printing apparatuses are proposed to be equipped with a microswitch instead of the photosensor to detect the end of the ink ribbon. Such printing apparatuses are disclosed in Japanese Patent Laid-Open Nos. Sho 61-95975 and Sho 57-199680. On these machines, when the ink ribbon has come to its end, the tension of the ribbon deforms an actuator inside the ink ribbon cassette. In turn, the deformed actuator turns on the microswitch. A controller connected to the microswitch then detects the end of the ink ribbon.

The microswitch-equipped ink ribbon end detecting mechanism detects reliably the end of the ink ribbon regardless of the ink ribbon color. However, this mechanism is provided only to make sure that the ink ribbon has indeed come to its end; it fails to detect other ribbon-related irregularities such as incorrect setting of the ribbon cassette.

SUMMARY OF THE INVENTION

It is therefore an object of the present invention to overcome the above-described drawbacks and disadvantages and to provide a printing apparatus that uses only one detector reliably to detect the end of an ink ribbon and to detect other ribbon-related irregularities such as an abnormally running ink ribbon or a ribbon cassette incorrectly mounted on the apparatus.

In achieving the foregoing and other objects of the present invention and according to one aspect thereof, there is provided a printing apparatus using a web type ink ribbon for a printing operation, comprising: feeding means for feeding the ink ribbon; output means for outputting a predetermined signal according to feeding of the ink ribbon; and determining means for determining whether the ink ribbon is correctly wound or not on the basis of the output signal from the output means while the feeding means feeds the ink ribbon.

In operation, the output means outputs the predetermined signal while the feeding means feeds the ink ribbon. In response to the output signal from the output means, the determining means determines whether the winding operation of the ink ribbon is carried out normally or not. When the ink ribbon reaches its end, the output means no longer outputs the signal. This allows the determining means to recognize that the ink ribbon winding operation is abnormal. Furthermore, when the ribbon cassette is set incorrectly, that status is also detected as an erroneous ink ribbon winding operation.

Further objects, features and advantages of the invention will become more apparent upon reading the following description and appended drawings.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENT

Figure 5:
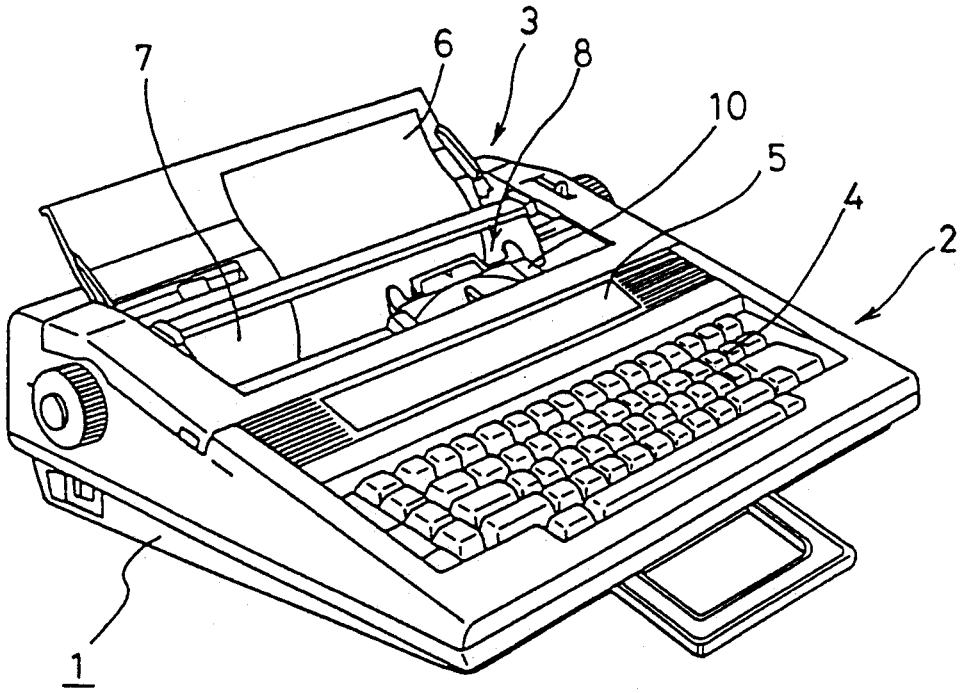
FIG. 5 is a perspective view of an electronic typewriter embodying the present invention.

The following is a detailed description of an electronic typewriter embodying the present invention, with reference to the accompanying drawings. First, the overall structure of the electronic typewriter 1 will be outlined referring to FIG. 5.

The electronic typewriter 1 is roughly composed of an input section 2 close to the user and a printing section 3 in the back of the input section 2. The input section 2 comprises a keyboard 4 and a liquid crystal display 5. The keyboard 4 is of the known type comprising a plurality of plastic resin keys that are assigned alphanumeric characters and various functions. From the keyboard 4, the user inputs desired characters and functions. The liquid crystal display 5 is also of the known type that displays words and sentences entered by the user as well as messages addressed to the user.

The printing section 3 comprises a platen 7 and a carriage 8. The platen 7 is a hard rubber cylinder rotatably attached inside the printing section 3. Supporting printing paper 6 on it, the platen 7 transports the paper 6 in its rotating direction when driven by hand or by a driving source, not shown. The carriage 8 is moved longitudinally, i.e., along the axial center of the platen 7, by a driving source, not shown. Furthermore, the carriage 8 is equipped with a character wheel and a printing hammer, not shown. In operation, the character wheel and printing hammer move along with the carriage 8. A ribbon cassette 10 is removably mounted on the carriage 8, the cassette containing inside a longitudinally extended ink ribbon 9 in tightly wound fashion. Words and sentences that are input through the input section 2 are printed on the printing paper 6 by the printing section 3. The printing hammer and character wheel in the printing section 3 operate in concert to transcribe each character by transferring ink from the ribbon onto the printing paper 6.

Figure 1:
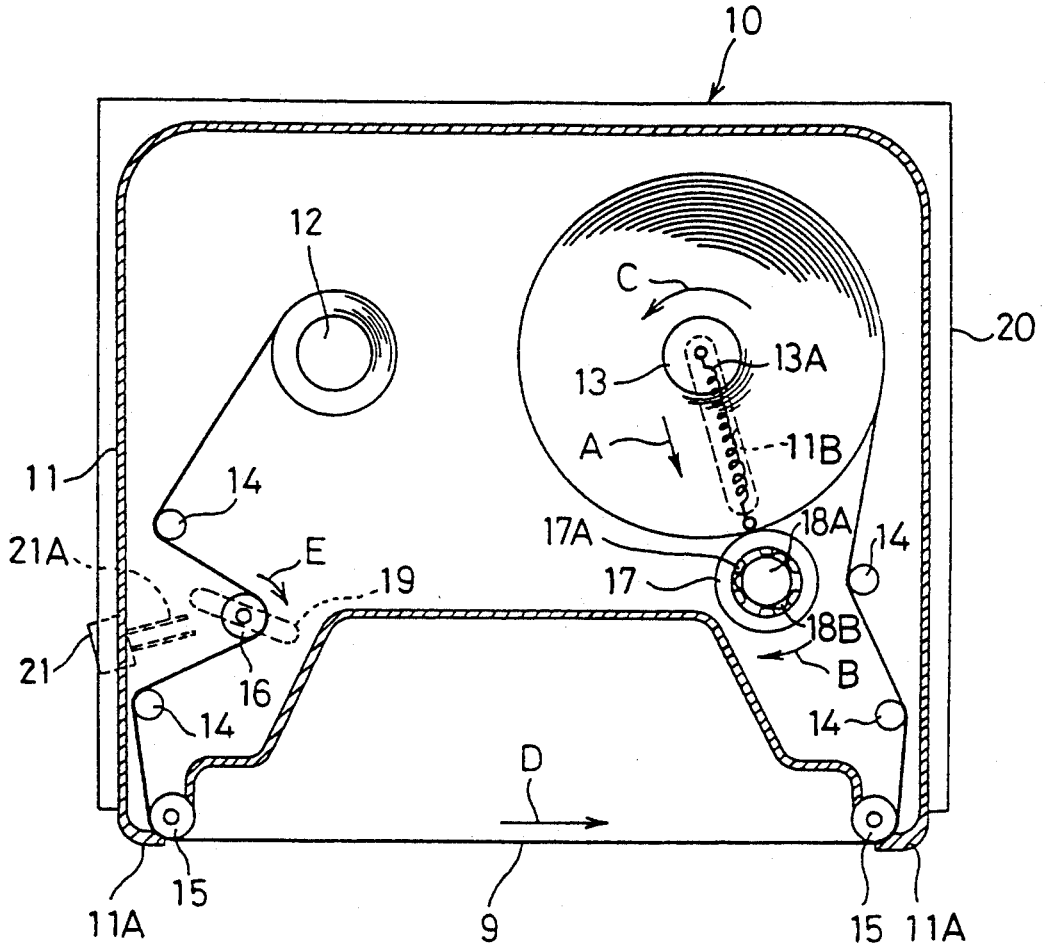
FIG. 1 is a transverse sectional view of a ribbon cassette mounted on a carriage of an electronic typewriter embodying the present invention.

The construction of the ribbon cassette 10 for use in this embodiment will now be described with reference to FIGS. 1 and 2. The ribbon cassette 10 comprises a case 11, the web type ink ribbon 9, a feed spool 12, a take-up spool 13, a plurality of tension guides 14, two guide rollers 15, a rotating roller 16 and a take-up roller 17.

The case 11 is an enclosure of the ribbon cassette 10 and is made of plastic resin. The entire case 11 is shaped as a thin rectangular box that is substantially symmetrical crosswise. Projections 11A appear downward from both ends of the case 11. Each projection 11A has an opening through which part of the surface of each guide roller 15 is exposed to the outside. An elongated hole 11B and round holes 11C and 11D are made on the case 11. The case 11 further contains all other components of the ribbon cassette 10.

The ink ribbon 9 is a known one-time use ink ribbon wound around the feed spool 12. The construction of the ribbon is well known and will not be detailed herein. After leaving the feed spool 12, the ink ribbon 9 is threaded through the multiple tension guides 14, rotating roller 16 and two guide rollers 15 before reaching the take-up spool 13. One end of the ink ribbon 9 is fixedly attached to the take-up spool 13.

The feed spool 12 is cylindrical in shape and made of plastic resin. The spool 12 is rotatably positioned where designated inside the case 11. As mentioned above, the longitudinally extended ink ribbon 9 is wound tightly around the feed spool 12.

The take-up spool 13 is also cylindrical in shape and made of plastic resin. The spool 13 is positioned in a rotatable and relocatable fashion in the elongated hole 11B inside the case 11. Furthermore, the take-up spool 13 is actuated in the arrowed direction A of FIG. 2 by a tension spring 13A so that the outermost portion of the wound ink ribbon 9 will remain tightly pressed against the take-up roller 17.

Each tension guide 14 is made of plastic resin. In this embodiment, four tension guides 14 are fixedly furnished inside the case 11. These tension guides do not rotate. Two tension guides 14 are located close to the feed spool 12; and the other two are located close to the take-up spool 13. As described above, the ink ribbon 9 is threaded past these tension guides 14 as well as through the guide roller 15 and rotating roller 16. The resulting tension on the ink ribbon 9 holds it taut when it is transported. The tension guides 14 may alternatively be made integral with the case 11.

The guide rollers 15 are each cylindrical in shape and made of plastic resin. Each guide roller 15 is rotatably attached to the projection 11A of the case 11.

As described, part of the surface of each guide roller 15 is exposed to the outside of the case through the opening of the projection 11A. Held between the two guide rollers 15 is an exposed portion of the ink ribbon 9 at which printing action is performed. After printing action, the used portion of the ink ribbon 9 proceeds in the arrowed direction D of FIG. 2 and is taken up consecutively by the take-up spool 13. As the used ink ribbon is being taken up, the unused portion of the ink ribbon 9 is fed from the feed spool 12 and appears exposed successively between the two guide rollers 15 for continuous printing action.

The rotating roller 16 is also cylindrical in shape and made of plastic resin. The roller 16 is rotatably positioned substantially in the middle between the two tension guides 14 close to the feed spool 12. As described, the ink ribbon 9 is fed from the feed spool 12 in the direction D even as the used ribbon portion is being taken up by the take-up spool 13. The tape feed causes the rotating roller 16 to rotate in the arrowed direction E of FIG. 2 without slippage. The rotating roller 16 has a shaft 16A that penetrates and protrudes out of the hole 11C at the bottom of the case 11. A rod-like actuator 19 extending in the diametrical direction of the rotating roller 16 is fixedly attached to the lower end of the shaft 16A. As the ink ribbon 9 is being taken up, the actuator 19 rotates correspondingly. The amount of rotation of the actuator 19 (i.e., angle of rotation) is proportional to the length of the ink ribbon 9 having been taken up.

The take-up roller 17 is rotatably positioned close to the take-up spool 13. The take-up roller 17 is a hollow cylinder made of plastic resin. Inside the hollow cylinder are a plurality of projections 17A. When the ribbon cassette 10 is mounted correctly on a cassette mounting portion 20 of the carriage 8, an output shaft 18A of a motor 18, to be described later, is inserted into the take-up roller 17. The output shaft 18A also has a plurality of projections 18B on its surface. When the output shaft 18A is inserted into the take-up roller 17, their projections 17A and 18B are engaged with one another. This allows the torque of the motor 18 to be transmitted directly to the take-up roller 17. The take-up roller 17 is thus rotated in the arrowed direction B by the motor 18. As discussed, the tension spring 13A actuates the take-up spool 13 in the arrowed direction A so that the outermost portion of the used ink ribbon 9 will stay pressed against the take-up roller 17. Thus, the take-up roller 17 rotating in the arrowed direction B causes the take-up spool 13 to rotate in the arrowed direction C as the spool 13 is taking up the ink ribbon 9. Because the circumference of the take-up roller 17 remains unchanged, each turn of the take-up roller 17 causes the take-up spool 13 to wind the length of ribbon equivalent to the roller circumference. Even as the ink ribbon 9 being wound around the take-up spool 13 becomes larger in roll size, every turn of the take-up roller 17 winds exactly the same length of ink ribbon as the roller circumference. As the wound roll of the used ink ribbon 9 grows in diameter, the take-up spool 13 moves in the opposite direction of the arrowed direction A against the tension of the tension spring 13A.

Figure 2:
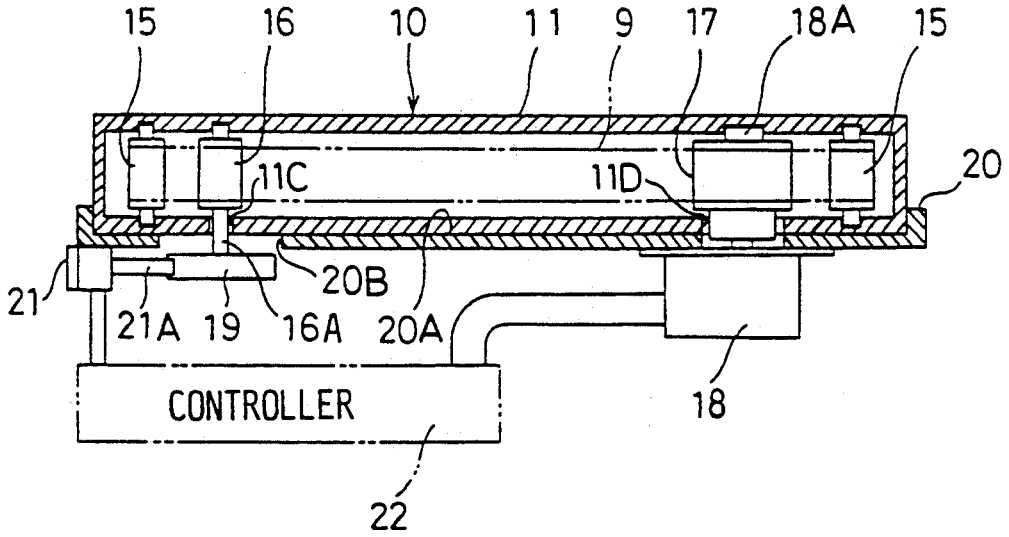
FIG. 2 is a longitudinal sectional view of the ribbon cassette mounted on the carriage in the embodiment.

The ribbon cassette 10 of the above construction is removably mounted on the cassette mounting portion 20 of the carriage 8, as illustrated in FIG. 2. With the ribbon cassette 10 mounted on the cassette mounting portion 20, the bottom of the case 11 attaches snugly to a mounting surface 20A. At this point, the printing hammer and the character wheel are so located as to be surrounded by the case 11, by the two projections 11A and by the exposed portion of the ink ribbon 9.

The cassette mounting portion 20 contains the motor 18 which may illustratively be a stepping motor that acts as the driving source providing the winding action of the ink ribbon 9. The output shaft 18A of the motor 18 penetrates and protrudes above the mounting surface 20A of the cassette mounting portion 20. As mentioned, when the ribbon cassette 10 is mounted correctly on the cassette mounting portion 20, the output shaft 18A penetrates the hole 11D at the bottom of the case 11 and engages with the inner circumference of the take-up roller 17. This allows the torque of the motor 18 to be transmitted directly to the take-up roller 17. The motor 18 is controlled by a controller 22.

When the ribbon cassette 10 is mounted on the cassette mounting portion 20, the actuator 19 fixedly attached to the shaft 16A of the rotating roller 16 penetrates a hole 20B on the mounting surface 20A of the cassette mounting portion 20 and protrudes downward. As depicted in FIG. 1, the cassette mounting portion 20 includes a switch 21 composed of a microswitch having two operating members 21A. The operating members 21A are each a thin metal terminal that is readily deformed elastically. The tip of each operating member 21A is located within the rotation locus of the actuator 19. When the electronic typewriter 1 performs printing, the ink ribbon 9 is fed from the feed spool 12. This causes the rotating roller 16 to rotate. That in turn rotates the actuator 19 fixedly attached to the shaft 16A of the rotating roller 16. During rotation, the two operating members 21A have their tips brought into and out of contact repeatedly with the two tips of the actuator 19. A contact stands for an ON state; and a non-contact, for an OFF state, each state represented by an appropriate signal. It is evident that a single turn of the actuator 19 (i.e., of rotating roller 16) causes the switch 21 to generate two ON-state signals and two OFF-state signals. With the switch 21 connected to the controller 22, the ON and OFF signals are input to the controller 22.

Figure 3:
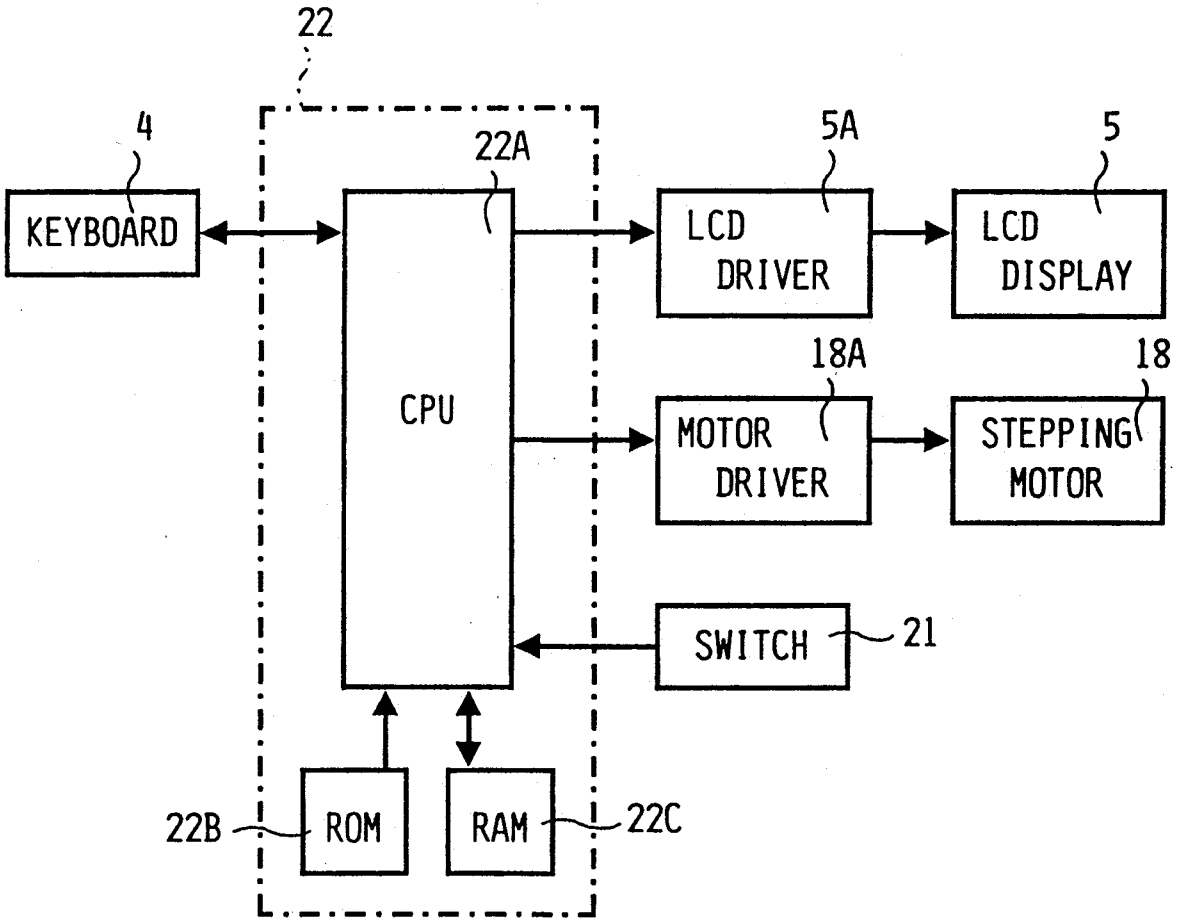
FIG. 3 is a block diagram showing an electrical construction in the embodiment.

The electrical construction of this embodiment will now be described with reference to FIG. 3. The above-mentioned controller 22 comprises a CPU (central processing unit) 22A, a ROM (read only memory) 22B and a RAM (random access memory) 22C. The ROM 22B and the RAM 22C are both connected to the CPU 22A. The CPU 22A is also connected to the keyboard 4, the switch 21, an LCD driver 5A for the liquid crystal display 5, and a motor driver 18A for the stepping motor 18. Furthermore, the CPU 22A is connected to other components, not shown, such as a motor for driving the carriage 8, a motor for driving the platen 7 and a motor for driving a floppy disk drive furnished as external storage. These components are not directly relevant to the invention and will not be discussed hereunder.

The CPU 22A controls the components of the electronic typewriter 1 according to the control program stored in the ROM 22B. In addition to the control program whose steps are shown in the flowchart to be described later, the ROM 22B contains various messages. The RAM 22C temporarily accommodates the input from the keyboard 3; data read from external storage, not shown; and variables A and B, to be discussed later.

The LCD driver 5A, under control of the CPU 22A, drives the liquid crystal display 5 to display the input from the keyboard 4 as well as various messages addressed to the user. The motor driver 18A, also controlled by the CPU 22A pulse drives the motor 18. In this embodiment, the rotation angle of the motor 18 is proportional to the wound length of the ink ribbon 9. Thus, for printing of each character, the CPU 22A drives the motor 18 using a predetermined number of pulses so as to take up the ink ribbon 9 exactly by the character length.

As described above, the controller 22 receives ON and OFF signals from the switch 21. As will be discussed later in more detail, the controller 22 checks during operation of the motor 18 (i.e., during printing) to see if the winding operation of the ink ribbon 9 is normal in accordance with the ON and OFF signals from the switch 21. If the controller 22 detects an abnormal winding operation of the ink ribbon 9, the controller 22 stops the printing action and displays on the liquid crystal display 5 a message indicating the winding error.

Below is a description of how an abnormal winding operation of the ink ribbon 9 is detected and how the end of the ink ribbon 9 is verified in the embodiment, with reference to FIGS. 1 through 5.

Figure 4:
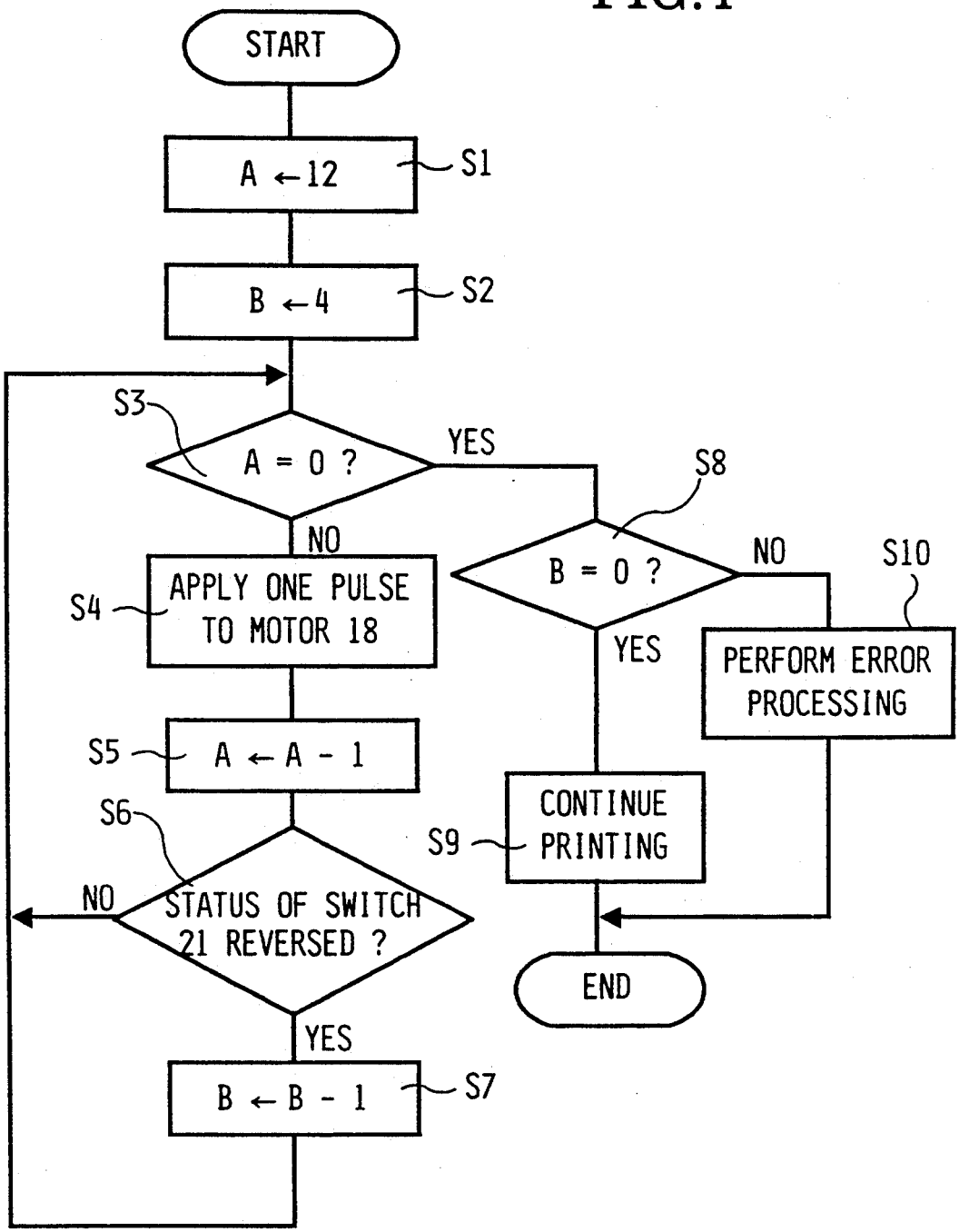
FIG. 4 is a flowchart of steps constituting the procedure for determining whether or not the ink ribbon winding operation is normal according to the present invention.

By following the steps of the flowchart in FIG. 4 during printing, the controller 22 checks for an abnormal winding operation of the ink ribbon 9 based on the ON and OFF signals coming from the switch 21. While the ink ribbon 9 is being wound normally, the rotation angle of the motor 18 remains proportional to the length of the ink ribbon 9 taken up (wound), as described. It follows that the rotation angle of the motor 18 (i.e., motor driving pulse count) is also proportional to the revolutions of the rotating roller 16 (i.e., of actuator 19). In this embodiment, as long as the ink ribbon 9 is wound normally, a 12-step angle turn of the motor 18 translates illustratively into a single-character printing length of the ink ribbon 9 being taken up by the take-up spool 13. At this point, the rotating roller 16 makes a single turn in keeping with the actuator 19 which also makes one turn. A single revolution of the actuator 19 causes each of its two ends to contact once the operating member 21A of the switch 21 (i.e., making a total of two contacts). In this embodiment, every 12 pulses applied to drive the motor 18 are to be accompanied by the switch 21 making four ON-OFF signal changes. To determine whether or not the above operating status is maintained, the CPU 22A determines if the ribbon cassette 10 is mounted incorrectly or if the end of the ribbon cassette is reached.

Referring now to FIG. 4, the user first starts a print start instruction by pressing a print start button, not shown. In step S1, the CPU 22A sets 12 as a variable A to the RAM 22C. The variable A is used to specify the number of pulses to be applied to drive the motor 18. In step S2, the CPU 22A sets 4 as a variable B to the RAM 22C. The variable B is used to designate the number of times the switch 21 is to perform ON-OFF signal changes. The two variables established above provide the following result: as described, when 12 pulses are applied to drive the motor 18 by a 12-step angle, the rotating roller 16 (i.e., actuator 19) makes a single turn and the switch 21 performs four ON-OFF signal changes, provided the ribbon cassette 10 is mounted correctly on the carriage 8 and that the ink ribbon 9 has not come to its end.

In step S3, the CPU 22A checks to see if the variable A stored in the RAM 22C is 0. If the variable A is judged to be other than 0 ("NO" decision in step S3), the CPU 22A reaches step S4 and applies one pulse to the motor 18. In step S5, the CPU 22A reads the variable A from the RAM 22C, subtracts 1 from the value A, and again places the result of subtraction as the variable A back to the RAM 22C. In step S6, the CPU 22A checks to see if the signal of the switch 21 changed from ON to OFF or vice versa during single-pulse application to the motor 18. If the signal is judged to have changed from ON to OFF or vice versa ("YES" decision in step S6), the CPU 22A reaches step S7. In step S7, the CPU 22A reads the variable B from the RAM 22C, subtracts 1 from the value B, and again places the result of subtraction as the variable B back to the RAM 22C. Step S7 is followed by step S3 in which the CPU 22A begins another run of the control program. If, in step S6, the CPU 22A judges that the signal of the switch 21 did not change from ON to OFF or vice versa during pulse application to the motor 18 ("NO" decision), the CPU 22A returns to step S3 for anther program run without changing the value of the variable B.

When the CPU 22A has executed steps S4 and S5 12 times, the motor 18 will have been given 12 pulses. Then the variable A reaches 0 in step S3 ("YES" decision). In that case, the CPU 22A reaches step S8 and reads the variable B from the RAM 22C to see if its value is 0. Meanwhile, as discussed, if the ribbon cassette 10 is mounted normally on the carriage 8 and if the ink ribbon 9 has not come to its end, the motor 18 makes a 12-step angle turn accompanied by the actuator 19 making a single turn, with the result that the switch 21 makes four ON-OFF signal changes. This should connote that step S4 is executed four times and that the variable B has reached 0. Thus, if the variable B turns out to be 0 in step S8 ("YES" decision), the CPU 22A reaches step S9. In step S9, the CPU 22A judges that the end of the ink ribbon 9 is not reached and that the ribbon cassette 10 is mounted normally on the carriage 8. The CPU 22A thus continues the current printing action to complete the printing of one character.

If the end of the ink ribbon 9 is reached, the ink ribbon 9 is no longer taken up by the take-up spool 13. This means that even if the motor 18 continues to be powered with pulses, the rotating roller 16 (i.e., actuator 19) now halts its rotation. With the actuator 19 stopped, the switch 21 discontinues ON-OFF signal changes. Thus, with the end of the ink ribbon 9 reached, no more subtraction is performed on the variable B (hence 0 no longer reached) regardless of the motor 18 being powered.

The variable B is also barred from subtraction when the ribbon cassette 10 is not mounted correctly on the cassette mounting portion 20. For example, if the ribbon cassette 10 is not on the mounting surface 20A, the actuator 19 is not in contact with the switch 21. This prevents the switch 21 from making ON-OFF signal changes. As a result, the variable B does not reach 0 in step S8. The variable B likewise fails to reach 0 if the ink ribbon 9 has snapped or is entangled halfway or if the take-up roller 17 has developed slippage.

When the variable B is other than 0 for the foregoing reasons, the CPU 22A judges in step S8 that an abnormal winding operation of the ink ribbon 9 has occurred ("NO" decision), and reaches step S10. In step S10, the CPU 22A performs error processing including discontinuation of the printing action of the electronic typewriter 1 and displaying of an error message on the liquid crystal display 5.

As described, the embodiment detects the number of times the switch 21 changes its ON-OFF signal status during application of the predetermined number of pulses to the motor 18. This feature makes it possible to unfailingly detect the end of the ink ribbon; to check for any abnormal winding operation of the ink ribbon 9; and to determine if the ribbon cassette 1 is mounted correctly on the cassette mounting portion 20. Unlike the conventional microswitch that only checks if the ink ribbon is wound up to its end, a single switch 21 in the embodiment provides more diverse and more reliable detecting functions.

Although the description above contains many specificities, these should not be construed as limiting the scope of the invention but as merely providing illustrations of the presently preferred embodiment of this invention. For example, instead of the actuator 19 being attached to the rotating roller 16, the actuator 19 may be alternatively mounted on a guide roller 15 that rotates in keeping with the winding operation of the ink ribbon 9. The actuator 19 may be other than rod-like in shape; its shape may alternatively be elliptical or cross-like.

The embodiment above detects abnormal conditions by verifying the number of times the switch 21 changes its ON-OFF signal status. Alternatively, the invention may be modified to detect irregularities by checking the presence of ON signals from the switch or by verifying the time interval in which ON signals are output. Furthermore, the microswitch may be replaced with an optical switch or with a magnetic switch in an alternative embodiment.

The embodiment above applies a predetermined number of pulses to the stepping motor 18 so as to wind the ink ribbon 9. Alternatively, a direct current motor may be utilized to perform the same task. In the latter case, what needs to be controlled is not the pulse count but the time in which to apply power to the motor.

Another modification of the invention may involve activating a buzzer to inform the user of an abnormal winding operation of the ink ribbon 9. A further modification may be to have the take-up spool rotated directly by a motor.

Thus the scope of the invention should be determined by the appended claims and their legal equivalents, rather than by the examples given.

What is claimed is:

1. A printing apparatus using a web type ink ribbon for a printing operation, comprising:

feeding means for feeding the ink ribbon comprising:

a feed spool supplying the ink ribbon;

a take-up spool having a peripheral surface, said take-up spool winding the ink ribbon;

a take-up roller always being pressed against the peripheral surface of said take-up spool; and a motor having a shaft driving said take-up roller;

output means for outputting a predetermined signal according to feeding of the ink ribbon comprising:

an actuator being fixedly attached to the shaft of one of said rotating roller and said guide roller; and a switch outputting the predetermined signal in accordance with rotation of said actuator;

determining means for determining whether the ink ribbon is correctly fed or not on the basis of said output signal from said output means while said feeding means feeds the ink ribbon, said determining means determining an abnormal feeding operation of the ink ribbon, an abnormal mounting of the ink ribbon, and a location of an end of the ink ribbon;

a tension guide applying tension to the ink ribbon;

a rotating roller rotating in accordance with feeding of the ink ribbon; and a guide roller guiding the ink ribbon and wherein said guide roller and said rotating roller have shafts.

2. The printing apparatus according to claim 1, wherein said actuator has at least one end portion.

3. The printing apparatus according to claim 2, wherein said switch has two operating members which are readily deformed elastically, said operating members being located within a rotation locus of the at least one end portion of said actuator;

wherein said switch outputs ON and OFF signals when said at least one end portion of said actuator is brought in and out of contact with said operating members, respectively.

4. The printing apparatus according to claim 3, wherein said determining means detects an abnormal winding operation of the ink ribbon in accordance with a number of switching times between an ON signal and an OFF signal when predetermined power is supplied to said motor.

5. The printing apparatus according to claim 4, wherein said determining means detects a normal winding operation of the ink ribbon when the number of switching times between the ON signal and the OFF signal is twice times of the number of the at least one end portion of the actuator during one rotation.

6. The printing apparatus according to claim 3, wherein said feed spool, said take-up spool, said ink ribbon, said tension guide, said rotating roller, said guide roller and said take-up roller are provided in a cassette case.

7. A printing apparatus using a ribbon cassette storing a web type ink ribbon, said ribbon cassette being detachably installed in said printing apparatus, comprising:

a carriage on which said ribbon cassette is detachably mounted;

feeding means for feeding the ink ribbon;

an actuator being provided on said ribbon cassette, said actuator rotating in accordance with the feeding of the ink ribbon, said actuator having at least one end portion;

a switch being fixedly provided on said carriage, said switch outputting a predetermined signal when said at least one end portion of said actuator comes in contact with said switch; and determining means for determining at least one of an abnormal feeding operation and an end of the ink ribbon on the basis of a number of the predetermined signals output by said switch.

8. The printing apparatus according to claim 7, wherein said feeding means comprises:

a feed spool supplying the ink ribbon;

a take-up spool having a peripheral surface, said take-up spool winding the ink ribbon;

a take-up roller always being pressed against the peripheral surface of said take-up spool; and a motor having a shaft driving said take-up roller.

9. The printing apparatus according to claim 8, further comprising:

a tension guide applying tension to the ink ribbon;

a rotating roller rotating in accordance with feeding of the ink ribbon; and a guide roller guiding the ink ribbon.

10. The printing apparatus according to claim 9, wherein said rotating roller and said guide roller have shafts and wherein said output means comprises an actuator being fixedly attached to the shaft of one of said rotating roller and said guide roller.

11. The printing apparatus according to claim 10, wherein said switch has two operating members which are readily deformed elastically, said operating members being located within a rotation locus of the at least one end portion of said actuator;

wherein said switch outputs ON and OFF signals when said at least one end portion of said actuator is brought in and out of contact with said operating members, respectively.

12. The printing apparatus according to claim 11, wherein said determining means detects an abnormal winding operation of the ink ribbon in accordance with a number of switching times between an ON signal and an OFF signal when predetermined power is supplied to said motor.

13. The printing apparatus according to claim 12, wherein said determining means detects a normal winding operation of the ink ribbon when the number of switching times between the ON signal and the OFF signal is twice times of the number of the at least one end portion of the actuator during one rotation.

14. A ribbon cassette which is detachably mounted on a printer having a switch detecting feeding of an ink ribbon, comprising:

a cassette case;

a feed spool on which the ink ribbon is wound;

a take-up spool taking-up a used portion of the ink ribbon, the ink ribbon being fed from the feed spool to the take-up spool;

at least one roller rotating in accordance with the feeding of the ink ribbon;

an actuator rotating with said at least one roller said actuator having at least one end portion for contacting said switch; and a determining means determining whether the ink ribbon is correctly fed or not on the basis of the detection of said switch at each of a plurality of predetermined time intervals.

15. The ribbon cassette according to claim 14, wherein said at least one roller comprises a rotating roller and a guide roller each having a shaft, wherein said actuator is fixedly attached to the shaft of one of said rotating roller and said guide roller.

16. The ribbon cassette according to claim 15, wherein said switch has two operating members which are readily deformed elastically, said operating members being located within a rotation locus of the at least one end portion of said actuator.

17. The ribbon cassette according to claim 14, wherein said determining means determines an end of the ink ribbon when said switch detects no feeding of the ink ribbon.

18. The ribbon cassette according to claim 15, further comprising a cassette mounting portion on which said cassette case is mounted, said cassette mounting portion having a hole extending therethrough, said determining means determining that said cassette case is properly mounted on said cassette mounting portion when said actuator penetrates said hole.

* * * * *